United States Patent [19]

Kukes et al.

[11] Patent Number: 4,954,241

[45] **Date of Patent: * Sep. 4, 1990**

[54] TWO STAGE HYDROCARBON CONVERSION PROCESS

[75] Inventors: Simon G. Kukes, Naperville, Ill.; Albert L. Hensley, Jr., Munster, Ind.; Jeffrey C. Kelterborn, Hinsdale; James L. Aderhold, Jr., Wheaton, both of Ill.

[73] Assignee: Amoco Corporation, Chicago, Ill.

[ * ] Notice: The portion of the term of this patent subsequent to Jan. 10, 2006 has been disclaimed.

[21] Appl. No.: 287,398

[22] Filed: Dec. 20, 1988

Related U.S. Application Data

[63] Continuation-in-part of Ser. No. 160,683, Feb. 26, 1988, Pat. No. 4,797,195.

[51] Int. Cl.[5] ..... C106 65/12

[52] U.S. Cl. ..... 208/59; 208/89; 208/111

[58] Field of Search ..... 208/111, 59, 89

[56] References Cited

U.S. PATENT DOCUMENTS

| | | | |
|---|---|---|---|
| 3,963,600 | 6/1976 | Hilfman | 208/59 |
| 4,183,801 | 1/1980 | Breuker et al. | 208/89 |
| 4,604,187 | 8/1986 | Ward | 208/111 |
| 4,743,355 | 5/1988 | Ward | 208/89 |
| 4,746,419 | 5/1988 | Peck et al. | 208/59 |
| 4,789,457 | 12/1988 | Fischer et al. | 208/68 |
| 4,797,195 | 1/1989 | Kukes et al. | 208/111 |
| 4,797,196 | 1/1989 | Kukes et al. | 208/111 |
| 4,812,224 | 3/1989 | Miller | 208/68 |
| 4,820,403 | 4/1989 | Gutberlet et al. | 208/68 |
| 4,828,676 | 5/1989 | Sawyer et al. | 208/59 |
| 4,834,865 | 5/1989 | Kukes et al. | 208/59 |

*Primary Examiner*—Anthony McFarlane

*Attorney, Agent, or Firm*—Ekkehard Schoettle; William H. Magidson; Ralph C. Medhurst

[57] ABSTRACT

Disclosed is a multiple stage process wherein a hydrocarbon feedstock is hydrotreated in a hydrotreating stage. After removal of ammonia and hydrogen sulfide from the hydrotreated feedstock, the hydrotreated feedstock is hydrocracked in a three zone hydrocracking stage.

6 Claims, No Drawings

TWO STAGE HYDROCARBON CONVERSION PROCESS

CROSS REFERENCE TO RELATED APPLICATIONS

The present application is a continuation-in-part of application Ser. No. 160,683 filed on Feb. 26, 1988, now U.S. Pat. No. 4,797,195.

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products Hydrocracking catalysts generally comprise a hydrogenation component on an acidic cracking support. More specifically, hydrocracking catalysts comprise a hydrogenation component selected from the group consisting of Group VIB metals and Group VIII metals of the Periodic Table of Elements their oxides or sulfides. The prior art has also taught that these hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component, the preferred Group VIB metals are tungsten and molybdenum; the preferred Group VIII metals are nickel and cobalt. The prior art has also taught that combinations of metals for the hydrogenation component, expressed as oxides and in the order of preference, are: $NiO-WO_3$, $NiO-MoO_3$, $CoO-MoO_3$, and $CoO-WO_3$. Other hydrogenation components broadly taught by the prior art include iron, ruthenium, rhodium, palladium, osmium, indium, platinum, chromium, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., show at Table V thereof that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermining end point to below that end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain no silica, however, the patent does not present an example showing the preparation of a catalyst devoid of silica nor does the patent teach the preferential use of nickel and tungsten as hydrogenation metals.

As can be appreciated from the above, there is a myriad of catalysts or catalyst systems known for hydrocracking whose properties vary widely. A catalyst suitable for maximizing naphtha yield may not be suitable for maximizing the yield of turbine fuel or distillate. Further, various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity since they are generally devoid of a cracking component that is capable of being poisoned. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contacting with a hydrocracking catalyst which contained a high amount of cracking component; i.e., a molecular sieve material.

For instance U.S. Pat. No. 3,923,638 to Bertolacini et al. discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIB metal and Group VIII metal and/or their compounds and a cocatalytic acidic support comprising a large-pore crystalline aluminosilicate material and refractory inorganic oxide. The hydrocracking catalyst comprises as a hydrogenation component a Group VIB metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable, large-pore crystalline aluminosilicate material.

It has previously been discovered that the naphtha yield of a two reaction zone hydrocracking process can be considerably improved by replacing 1 to 30 wt. % of the first zone hydrocracking catalyst with a non-sieve containing catalyst.

In particular, where a two-zone hydrocracking process involves the initial contact with a catalyst comprising a nickel component and a tungsten component deposed on a support component containing an alumina component and a crystalline molecular sieve component followed by contact with a catalyst comprising a cobalt component and a molybdenum component deposed on a support component containing a silica-alumina component and a crystalline molecular sieve component; if 1 to about 30 wt. % of the first reaction zone catalyst is replaced with a catalyst comprising a nickel component and a molybdenum component deposed on a support containing a refractory inorganic oxide component devoid of a crystalline molecular sieve component the naphtha yield is considerably improved.

An attendant advantage of carrying out this replacement of catalyst in the first zone is a reduction in overall catalyst cost since the non-sieve containing catalyst is markedly less expensive than the replaced catalyst.

It has now been discovered that the activity of the above-described three-zone hydrocracking process can be markedly increased by hydrotreating the feedstock prior to passing it to the three-zone hydrocracking process.

An attendant advantage of increasing the activity of the catalyst in the hydrocracking stage is the ability to increase the throughput of feed to the hydrocracking process unit.

The process of the invention also yields a naphtha fraction having a high octane affording aromatics content.

SUMMARY OF THE INVENTION

This invention relates to a multiple stage process wherein a hydrocarbon feedstock containing nitrogen- and sulfur-containing compounds is first hydrotreated in a hydrotreating stage comprising a hydrotreating reaction zone wherein hydrogen is contacted with the feedstock in the presence of a hydrotreating catalyst at hydrotreating conditions wherein a substantial portion of the nitrogen- and sulfur-containing compounds are converted to hydrogen sulfide and ammonia.

At least a portion of the effluent from the hydro-treating stage is then passed to a stripping zone wherein hydrogen sulfide and ammonia are removed to form a stripping zone effluent.

At least a portion of the stripping zone effluent is then passed to a hydrocracking stage comprising a plurality of hydrocracking reaction zones in series wherein hydrogen is contacted with the stripping zone effluent in the presence of hyrocracking catalysts at hydrocracking conversion conditions.

Specifically, the stripping zone effluent is contacted in a first hydrocracking reaction zone with a first hydrocracking reaction zone catalyst comprising a nickel component and a molybdenum component deposed on a support consisting essentially of a refractory inorganic oxide. The effluent from the first reaction zone is then contacted in a second hydrocracking reaction zone with a second hydrocracking reaction zone catalyst comprising a nickel component and a tungsten component deposed on a support component consisting essentially of an alumina component and a crystalline molecular sieve component. The effluent from the second hydrocracking reaction zone is then contacted in a third hydrocracking reaction zone with a third hydrocracking reaction zone catalyst comprising a cobalt component and a molybdenum component deposed on a support component comprising a silica-alumina component and a crystalline molecular sieve component.

DETAILED DESCRIPTION OF THE INVENTION

The hydrocarbon feedstock suitable for use in accordance with the process of this invention is selected from the group consisting of petroleum distillates, solvent deasphalted petroleum residua, shale oils and coal tar distillates. These feedstocks typically have a boiling range above about 200° F. and generally have a boiling range between 350° to 950° F. More specifically these feedstocks include heavy distillates, heavy straight-run gas oils and heavy cracked cycle oils, as well as fluidized catalytic cracking unit feeds.

The process of the invention is especially suitable in connection with handling feeds that include a light catalytic cycle oil. This light catalytic cycle oil generally has a boiling range of about 350° to about 750° F., a sulfur content of about 0.3 to about 2.5 wt. %, a nitrogen content of about 0.01 to about 0.15 wt. % and an aromatics content of about 40 to about 90 vol. %. The light catalytic cycle oil is a product of the catalytic cracking process.

In accordance with the process of the invention, the above-described feedstock is first contacted with a hydrotreating catalyst in hydrotreating stage at hydrotreating conditions.

Suitable operating conditions in the hydrotreating stage are summarized below:

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1800 |
| LHSV | .10–20 | .25–2.5 |
| Hydrogen rate, SCFB | 500–20,000 | 800–6,000 |
| Hydrogen partial pressure, psig | 50–3,500 | 500–1,000 |

The hydrotreater stage is also preferably operated at conditions that will result in an effluent stream having less than 10 ppmw nitrogen-containing impurities, based on nitrogen, and less than 20 ppmw sulfur-containing compounds or impurities, based on sulfur, and most preferably less than 5 ppmw and 10 ppmw, respectively. The above-set out preferred nitrogen and sulfur contents correspond to substantial conversion of the sulfur and nitrogen compounds entering the hydrotreater to hydrogen sulfide and ammonia.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chromia, beryllia, and mixtures thereof. A preferred hydrotreating catalyst contains sulfides or oxides of Ni and Mo composited with an alumina support wherein the Ni and Mo are present in amounts ranging from 0.1 wt. % to 10 wt. % calculated as NiO and 1 wt. % to 20 wt. % calculated as $MoO_3$ based on total catalyst weight.

Prior to passing the hydrotreating stage effluent to the hydrocracking stage, the $H_2S$ and $NH_3$ are stripped from the hydrotreating stage effluent in a conventional manner in any suitable gas-liquid separation zone.

Operating conditions to be used in each hydrocracking reaction zone comprising the hydrocracking stage in the process of the invention include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is naphtha selective with decreased production of light gases. Further, the activity of the catalyst in the hydrocracking stage is enhanced by carrying out the hydrotreating step prior to the hydrocracking step.

The hydrocracking stage of the process of the present invention is preferably carried out in a plurality of reaction zones where each zone contains a catalyst that is different than the catalyst in the other zones. Each reaction zone can comprise one or a plurality of beds that have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

In the hydrocracking stage of the process of the invention, there is no removal of gases between reaction zones.

The catalysts used in the process of the present invention comprise a hydrogenation component and a catalyst support.

The hydrogenation component of the catalysts employed in the process of the invention comprises a Group VIB metal component and a Group VIII metal component. These components are typically present in the oxide or sulfide form.

The first reaction zone catalyst hydrogenation component comprises nickel and molybdenum. These metals and/or their compounds are present in the amounts specified below. These amounts are based on the total catalytic composite or catalyst weight and are calculated as the oxides NiO, and $MoO_3$.

| | Broad | Preferred | Most Preferred |
|---|---|---|---|
| NiO, wt. % | 0.5–10 | 1–6 | 1.5–4 |
| $MoO_3$, wt. % | 2–20 | 5–18 | 8–16 |

The above-described hydrogenation component is deposed on a support component consisting essentially of a refractory inorganic oxide. The first reaction zone catalyst support is essentially devoid of a crystalline molecular sieve component. Preferred refractory inorganic oxides are silica-alumina, and alumina.

The hydrogenation component of the second reaction zone catalyst comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–10.0 | 0.0–6.0 | 0.0–3.0 |

Another component of the second reaction zone catalytic composite or catalyst is the support. The support contains a crystalline molecular sieve material and alumina. The preferred alumina is gamma alumina. The crystalline molecular sieve material is present in an amount ranging from about 10 to about 60 wt. %, preferably from about 25 to about 50 wt. % based on total support weight.

Preferably, the crystalline molecular sieve material is distributed throughout and suspended in a porous matrix of the alumina. The use of alumina in the second stage catalyst support is in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material. The use of alumina is preferred in the second stage catalyst because it serves to increase hydrogenation activity as opposed to hydrocracking activity. It is preferable to carry out hydrogenation reactions prior to the hydrocracking reactions because the hydrocracking reaction will take place at a faster rate with hydrogenated reactants.

The hydrogenation component of the third reaction zone catalyst comprises cobalt and molybdenum and/or their compounds, these metals are present in the amounts specified below. These amounts are based on the total catalytic composite or catalyst weight and are calculated as the oxides CoO and $MoO_3$.

| | Broad | Preferred | Most Preferred |
|---|---|---|---|
| CoO, wt. % | 1–6 | 1.5–5 | 2–4 |
| $MoO_3$, wt. % | 3–20 | 6–15 | 8–12 |

The third reaction zone support comprises a crystalline molecular sieve component and a silica-alumina component. The crystalline molecular sieve material is present in an amount ranging from about 10 to 60 wt. % and preferably from about 25 to 50 wt. %. The use of silica-alumina in the support is preferred because it serves to yield a product containing a higher iso to normal ratio for the pentane fraction thereof.

In all cases the hydrogenation component may be deposited upon the support by impregnation employing heat-decomposable salts of the above-described metals or any other method known to those skilled in the art. Each of the metals may be impregnated onto the support separately, or they may be co-impregnated onto the support. The composites are subsequently dried and calcined to decompose the salts and to remove the undesired anions.

The supports may be prepared by various well-known methods and formed into pellets, beads, and extrudates of the desired size. For example, the crystalline molecular sieve material may be pulverized into finely divided material, and this latter material may be intimately admixed with the refractory inorganic oxide. The finely divided crystalline molecular sieve material may be admixed thoroughly with a hydrosol or hydrogel of the inorganic oxide. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of faujasite-type crystalline aluminosilicates, and mordenite-type crystalline aluminosilicates. Although not preferred, crystalline aluminosilicates such as ZSM-5, ZSM-11, ZSM-12, ZSM-23, and ZSM-35, and an AMS-1B crystalline molecular sieve can also be used with varying results alone or in combination with the faujasite-type or mordenite-type crystalline aluminosilicate. Examples of a faujasite-type crystalline aluminosilicate are low-alkali metal Y-type crystalline aluminosilicates, metal-exchanged X-type and Y-type crystalline aluminosilicates, and ultrastable, large-pore crystalline aluminosilicate material. Zeolon is an example of a mordenite-type crystalline aluminosilicate.

In another embodiment a portion of the molecular sieve component present in the catalyst support utilized in the second hydrocracking reaction zone can be a gallosilicate. The use of gallosilicates in hydrocracking catalysts is described in detail in application Ser. No. 07/287,399 the teachings of which are incorporated by reference herein.

Ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability in elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt. % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that is preferred for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,6251 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Another example of a crystalline molecular sieve zeolite that can be employed in the catalytic composition of the present invention is a metal-exchanged Y-type molecular sieve. Y-type zeolitic molecular sieves are discussed in U.S. Pat. No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such a rare earth metal-exchanged Y-type molecular sieve can be employed suitably in the catalytic composition of the present invention. Specific examples of suitable rare earth metals are cerium, lanthanum, and praseodymium.

A zeolitic molecular sieve suitable for use in the present invention, as mentioned above, is a ZSM-5 zeolite. Descriptions of the ZSM-5 composition and its method of preparation are presented by Argauer, et al., in U.S. Pat. No. 3,702,886. This patent is incorporated by reference herein and made a part hereof.

An additional molecular sieve that can be used in the catalytic compositions of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$0.9\pm0.2M_{2/n}O:B_2O_3:YSiO_2:ZH_2O$, wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

The catalysts used in the present invention can be used in any form such as pellets, spheres, extrudates, or other shapes having particular cross sections such as a clover leaf, or "C" shape.

In accordance with the process of the invention, the preferred amounts of catalyst in each respective zone are set out below as a volume percentage range of the overall amount of catalyst used in the process.

| | Broad | Preferred |
|---|---|---|
| Zone 1 | 2-30 | 5-15 |
| Zone 2 | 10-90 | 20-60 |
| Zone 3 | 5-80 | 20-60 |

In a preferred embodiment of the present invention the catalyst situated at the downstream portion of the plurality of reaction zones possesses a small nominal size while the remaining upstream portion of the total amount of catalyst possesses a large nominal size greater than the small nominal size catalyst. Specifically, the small nominal size is defined as catalyst particles having a U.S. Sieve mesh size ranging from about 10 to 16 preferably 10 to 12. The large nominal size catalyst preferably ranges from about 5 to about 7 U.S. Sieve mesh size. Further details of this preferred embodiment are disclosed in U.S. Ser. No. 160,524, filed on Feb. 26, 1988, the teachings of which are incorporated by reference.

Generally, the small nominal size hydrocracking catalyst is present in an amount ranging from about 5 to 70 wt. % of the total overall amount of catalyst used in this invention. Preferably, this amount ranges from about 10 to about 60 wt. %. Most preferably the third reaction zone consists of 3 catalyst beds wherein the last or most downstream catalyst bed in the third reaction zone contains third reaction zone catalyst having a U.S. Sieve mesh size of about 10 to 12. The remaining two upstream beds in the third reaction zone contain catalyst having a nominal particle size of about 5 to about 7 mesh (U.S. Sieve). In this connection preferably the first reaction zone consists of one catalyst bed wherein the first reaction zone catalyst has a nominal particle size of about 5 to about 7 mesh (U.S. Sieve).

The second reaction zone also consists of one catalyst bed containing second reaction zone catalyst having a nominal particle size of about 5 to about 7 mesh (U.S. Sieve).

The amount of small nominal size hydrocracking catalyst used in the process of the invention can be limited in accordance with the desired overall pressure gradient. This amount can be readily calculated by those skilled in the art as explained in U.S. Pat. No. 3,796,655 (Armistead et al.) and U.S. Pat. No. 3,563,886 (Carlson et al.)

The present invention is described in further detail in connection with the following Examples, it being understood that these examples are for purposes of illustration and not limitation.

EXAMPLE 1

The hydrocracking stage of the process of the invention was compared with an alternative hydrocracking process not utilizing the catalyst of the first zone in accordance with the hydrocracking stage of the present invention, namely the catalyst containing Ni and Mo deposed upon an alumina support.

Specifically, the hydrocracking stage of the process of the invention was tested in a reactor having catalyst beds loaded as set out below:

| | wt. g. | V., cc | catalyst |
|---|---|---|---|
| bed 1 | 3.38 | 3.98 | NiMo/Al |
| bed 2 | 6.53 | 7.96 | NiW/Al-USY |
| beds 3-5 | 17.44 | 23.88 | CoMo/SiAl-USY |

The comparative process was carried out in a reactor loaded as set out below:

| | wt. g. | V., cc | catalyst |
|---|---|---|---|
| beds 1 and 2 | 9.79 | 11.94 | NiW/Al-USY |
| beds 3-5 | 17.44 | 23.88 | CoMo/SiAl-USY |

All of the catalyst was mixed with inert alundum to improve flow distribution and maintain better temperature control in a catalyst to alundum volume ratio of about 1:2.

The comparative process and the hydrocracking stage of the process in accordance with the invention were used to convert a light catalytic cycle oil feedstock to naphtha and distillate products.

Both the comparative process and the hydrocracking stage of the process of the invention test runs were carried out on a "once-through" basis at 1250 psig, a WHSV of 1.45 and a hydrogen flow rate of 12,000 SCFB. Temperature was adjusted to maintain 77 wt. % conversion of the feed material boiling above 380° F. to material boiling below 380° F.

Table 1 below sets out the properties of the feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |

TABLE 1-continued

| Feed Properties | |
|---|---|
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the compositions of the respective catalysts. Shell-324 is a commercially available denitrogenation catalyst.

TABLE 2

| | Catalyst Properties | | |
|---|---|---|---|
| | NiMo/Al | NiW/Al/USY | CoMo/SiAl/USY |
| Chemical Composition, wt % | | | |
| $MoO_3$ | 19.8 | | 10.55 |
| $WO_3$ | — | 17.78 | — |
| NiO | 3.3 | 1.90 | — |
| CoO | — | — | 2.5 |
| $Na_2O$ | — | .13 | .07 |
| $SO_4$ | — | .29 | .13 |
| Support Composition, wt % | | | |
| Silica | 0 | | 0 |
| Alumina | 100 | 65 | |
| Silica-alumina | 0 | | |
| Crystalline molecular | | | 65 |
| Sieve | 0 | 35 | 35 |
| Surface Properties | | | |
| S.A., $m^2/g$ | 150 | 350 | 384 |
| Unit Cell Size | — | 24.51 | 24.52 |
| Crystallinity, % | — | 94 | 110 |
| Physical Properties | | | |
| Density, $lbs/ft^3$ | 50.0 | 49.7 | 45.5 |
| Crush Strength, lbs/mm | — | 7.4 | 4.5 |
| Abrasion Loss, wt % (1 hr) | — | 1.2 | .4 |

The following Table 3 sets out the selectivities for both the comparative process and the hydrocracking stage of the process of the invention corrected to the common conditions of 725° F. and 77 wt. % conversion of the material boiling above 380° F. to material boiling below 380° F. These "corrected selectivities" were calculated from "corrected yields." The method and equations used to calculate the "corrected" yields are set out at U.S. Pat. No. 3,923,638 (Bertolacini et al.) the teachings of which are incorporated by reference.

TABLE 3

| | Comparative | Invention Hydrocracking Stage |
|---|---|---|
| Dry Gas | 5.30 | 5.00 |
| Butane | 12.81 | 12.32 |
| Pentane | 11.20 | 10.97 |
| Light Naphtha | 17.29 | 16.80 |
| Heavy Naphtha | 56.45 | 57.91 |
| I/N $C_5$ | 3.07 | 3.36 |
| I/N $C_4$ | 1.34 | 1.26 |

Catalyst activity after 21 days of contact with the light catalytic cycle oil feed (corrected to 77 wt.% conversion) was 729.7° F. for the invention hydrocracking stage test, and 726° F. for the comparative test. Thus the invention hydrocracking stage was slightly less active, but considerably more selective to heavy naphtha at the expense of less valuable products such as dry gas butanes, pentanes, and light naphtha.

EXAMPLE 2

Another specific aspect of the hydrocracking stage of the process of the invention was compared with an alternative prior art process.

The reactor used to carry out the hydrocracking stage of the invention was loaded as set out below:

| | wt. g. | V., cc | catalyst |
|---|---|---|---|
| bed 1 | 3.38 | 3.98 | NiMo/Al |
| bed 2 | 6.53 | 7.96 | NiW/Al-USY |
| beds 3 and 4 | 11.63 | 15.92 | CoMo/SiAl-USY |
| bed 5 | 5.81 | 7.96 | CoMo/SiAl-USY |

All of the catalyst loaded in beds 1 through 4 possessed a nominal particle size of about ⅛-inch (6 mesh U.S. Sieve). The catalyst loaded in bed 5 possessed a nominal particle size of about 1/16-inch (10–12 mesh U.S. Sieve). The catalysts used in the above set out reactor loading possessed the same compositions as described in the invention run of Example 1 except that the cobalt content of the catalyst in bed 5 was 3.0 wt. %.

The prior art comparative process was carried out in a reactor loaded as set out below:

| | wt. g. | V., cc | catalyst |
|---|---|---|---|
| beds 1 and 2 | 10.15 | 11.94 | NiW/SiAl-USY |
| beds 3–5 | 17.44 | 23.88 | CoMo/SiAl-USY |

All of the catalyst loaded into the reactor possessed a nominal particle size of about ⅛-inch (6 mesh U.S. Sieve). The catalyst containing CoMo/SiAl-USY possessed the same composition as setout in Table 2.

The properties of the NiW/SiAl-USY catalyst are set out below in Table 4.

TABLE 4

| | NiW/Al/USY |
|---|---|
| Chemical Composition wt % | |
| $WO_3$ | 17.60 |
| NiO | 2.13 |
| $Na_2O$ | 0.9 |
| $SO_4$ | 0.21 |
| Support Composition, wt % | |
| Silica-alumina | |
| Crystalline molecular | |
| Sieve | |
| Surface Properties | |
| S.A., $m^2/g$ | 348 |
| Unit Cell Size | 24.52 |
| Crystallinity, % | 105 |
| Physical Properties | |
| Density, $lbs/ft^3$ | 52.8 |
| Crush Strength, lbs/mm | 7.4 |
| Abrasion Loss, wt % (1 hr) | .8 |

Both reactors were loaded with inert alundum as described in Example 1.

The comparative process and the hydrocracking stage of the process of the invention were carried out to convert a light catalytic cycle oil feedstock having the composition set out in Table 1.

Both the comparative process and the hydrocracking stage invention test runs were carried out on a "once-through" basis at 1250 psig, a WHSV of 1.45 and a hydrogen flow rate of 12,000 SCFB. The reactor temperature was adjusted to maintain 77 wt. % conversion of the feed material boiling above 380° F. to material boiling below 380° F.

The following Table 5 sets out the selectivities for both the comparative process and the hydrocracking stage of the process of the invention corrected to the common conditions as described in Example 1 of 725° F. and 77 wt. % conversion.

TABLE 5

| | Comparative | Invention Hydrocracking Stage |
|---|---|---|
| Dry Gas | 5.69 | 4.85 |
| Butane | 13.07 | 11.73 |
| Pentane | 11.27 | 10.39 |
| Light Naphtha | 16.61 | 15.97 |
| Heavy Naphtha | 56.36 | 60.06 |

In this example, the comparative process did not utilize the catalysts deposed in zones 1 and 2 in accordance with the hydrocracking stage of the present invention. The hydrocracking stage of the invention process afforded an increase of about 3.7% in heavy naphtha selectivity at the expense of less valuable products such as dry gas, butanes, pentanes, and light naphtha.

After 21 days on stream, the temperature required to maintain 77 wt. % conversion for the comparative run was 734.5° F. while the subject temperature for the invention hydrocracking stage run was 722.7°, a marked improvement in activity.

EXAMPLE 3

Two different feedstocks, in particular, light catalytic cycle oils, designated as A and B having the properties set out in Table 6 were hydrotreated by two different hydrotreating catalysts. Feedstock A was hydrotreated with commercially available hydrotreating catalyst containing nickel and molybdenum supported on alumina, while feedstock B was hydrotreated with a commercially available hydrotreating catalyst containing nickel and tungsten supported on alumina. The hydrotreating was carried out at hydrotreating conditions including 650° F., 800 psig hydrogen, and a weight hourly space velocity of 1.0.

TABLE 6

| | Feedstock Properties | |
|---|---|---|
| | A | B |
| C, Wt. % | 89.15 | 88.60 |
| H, Wt. % | 10.18 | 10.37 |
| API Gravity | 19.9 | 21.9 |
| S, Wt. % | .430 | .55 |
| N, ppm | 340 | 538 |
| Paraffins, Wt. % | 30.0 | 30.0 |
| Total Aromatics, Wt. % | 70.0 | 70.0 |
| Naphthalene, Wt. % | 34.0 | 26.0 |
| Phenanthrene, Wt. % | 5.5 | 5.5 |
| Distillation, °F. | | |
| 5 Wt. % | 454 | 391 |
| 10 Wt. % | 478 | 417 |
| 30 Wt. % | 513 | 476 |
| 50 Wt. % | 534 | 530 |
| 70 Wt. % | 562 | 593 |
| 90 Wt. % | 609 | 661 |
| 95 Wt. % | 655 | 686 |
| 99 Wt. % | — | 726 |
| FBP | — | 741 |

Hydrotreated feedstocks A and B were then blended in equal volume amounts to form feedstock C. Also, a blend of the hydrotreated feedstock C along with feedstock B was prepared on an equal volume basis to form feedstock D. Table 7 sets out the properties of the hydrotreated feedstocks blend, feedstock C, and the blend of hydrotreated feedstock C and nonhydrotreated feedstock B, i.e., feedstock D.

TABLE 7

| | Feedstock Properties | |
|---|---|---|
| Feedstock | C | D |
| C, Wt. % | 88.09 | 88.40 |
| H, Wt. % | 11.66 | 11.03 |
| API Gravity | 26.2 | 24.1 |
| S, Wt. % | 0.04 | 0.33 |
| N, ppm | 19 | 300 |
| Parraffins, Wt. % | 38.2 | 33.6 |
| Total Aromatics, Wt. % | 63.8 | 66.4 |
| Naphthalene, Wt. % | 1.0 | 3.2 |
| Distillation, °F. | | |
| 5 Wt. % | 372 | 385 |
| 10 Wt. % | 409 | 412 |
| 30 Wt. % | 472 | 474 |
| 50 Wt. % | 513 | 519 |
| 70 Wt. % | 562 | 573 |
| 90 Wt. % | 625 | 641 |
| 95 Wt. % | 653 | 667 |
| 99 Wt. % | 701 | 709 |
| FBP | 717 | 722 |

The process of the invention was compared with a comparative, alternative process. In accordance with the invention, feedstocks C and D were hydrocracked in a reactor having beds loaded as set out in Example 2 wherein the hydrocracking stage of the invention is exemplified. The comparative process was carried out by charging nonhydrotreated feedstock B to the same hydrocracking stage.

Table 2 above, sets out the catalyst compositions of each of the catalysts employed in the process of the invention hydrocracking stage.

The hydrocracking stage of the process of the invention was carried out on a "once-through" basis at 1250 psig, a WHSV of 1.45 at a hydrogen flow rate of 12,000 SCFB. Reactor temperature was adjusted to maintain 77 wt. % conversion of the feed material boiling above 380° F. to material boiling below 380° F.

The hydrocracking step carried out in connection with the comparative process wherein feedstock B was charged to the reactor was carried out at the same conditions. Products from each run were analyzed every day for conversion and product distribution. Table 8 below sets out the catalyst activity data after the reactor temperature reached a steady-state value (corrected to 77 wt. % conversion) for the process of the invention, and the comparative process wherein the feed to the hydrocracking stage had not been hydrotreated.

TABLE 8

| | Hydrocracking Activity (Temperature Of At 77% Conversion) | | |
|---|---|---|---|
| Run | Feedstock | LHSV | TEMP, °F. |
| 1 | B | 1.2 | 721 |
| 2 | C (INV) | 1.2 | 659 |
| 3 | C (INV) | 1.8 | 684 |
| 4 | D (INV) | 1.6 | 733 |
| 5 | B | 1.6 | 749 |
| 6 | C (INV) | 1.6** | 676 |

**Calculated by linear interpolation of LHSV between 1.2 and 1.8.

These data emphatically demonstrate that when the feed to the hydrocracking stage is hydrotreated or at least a portion of it is hydrotreated, a considerably lower temperature is required to maintain 77 wt. % conversion. For instance, feedstock C, in accordance with the invention where all of the feed is hydrotreated prior to hydrocracking, the temperature for the subject conversion is about 62° F. lower than the temperature required to convert feedstock B which has not been hydrotreated. Further, advantageously when the liquid hourly space velocity was increased by 50% to 1.8, the temperature required to maintain the desired conversion is still about 37° F. lower than the comparative case wherein the feed is not first hydrotreated. Thus the throughput to the hydrocracking stage can be substantially increased without engendering an unacceptable effect of catalyst activity.

In the case where the equal volume blend of hydrotreated feed and nonhydrotreated feed is used, feedstock D, the activity advantage was afforded at the higher space velocity (1.6 LHSV) but not when compared to the comparative lower space velocity case. The temperature required to maintain 77 wt. % conversion for feedstock D was about 15° F. lower than the temperature required to convert the nonhydrotreated feedstock B.

The following Table 9 sets out the distribution in weight percent of the constituents of the naphtha or $C_6$+ fraction for the products obtained in invention Runs 2, 3, and 4 and comparative Run 1.

TABLE 9

| | Naphtha Constituents, wt. % | | | |
|---|---|---|---|---|
| Run | 1 | 2 | 3 | 4 |
| Paraffins | 2.95 | 1.86 | 2.13 | 2.31 |
| C-6 | 1.28 | 0.86 | 0.90 | 1.08 |
| C-7 | 0.61 | 0.37 | 0.40 | 0.49 |
| C-8 | 0.41 | 0.23 | 0.26 | 0.32 |
| C-9 | 0.24 | 0.17 | 0.19 | 0.17 |
| C-10 | 0.18 | 0.14 | 0.33 | 0.12 |
| C-11 | 0.15 | 0.06 | 0.09 | 0.08 |
| C-12+ | 0.08 | 0.02 | 0.02 | 0.05 |
| Isoparaffins | 24.96 | 23.96 | 24.24 | 24.75 |
| I-6 | 7.28 | 7.55 | 8.83 | 8.36 |
| I-7 | 5.34 | 5.15 | 5.61 | 5.67 |
| I-8 | 4.43 | 4.15 | 4.19 | 4.32 |
| I-9 | 3.49 | 3.18 | 2.96 | 3.11 |
| I-10 | 2.77 | 2.50 | 1.99 | 2.25 |
| I-11 | 1.06 | 0.96 | 0.49 | 0.69 |
| I-12+ | 0.59 | 0.47 | 0.17 | 0.35 |
| Naphthenes | 42.51 | 44.15 | 41.46 | 40.02 |
| N-6 | 5.23 | 5.07 | 5.82 | 5.65 |
| N-7 | 10.31 | 10.67 | 11.23 | 10.63 |
| N-8 | 10.09 | 11.15 | 11.10 | 10.07 |
| N-9 | 7.91 | 8.63 | 7.97 | 7.42 |
| N-10 | 5.62 | 5.42 | 4.00 | 4.28 |
| N-11 | 2.16 | 2.09 | 0.99 | 1.32 |
| N-12+ | 1.19 | 1.03 | 0.35 | 0.65 |
| Aromatics | 29.58 | 30.03 | 32.17 | 32.93 |
| A-6 | 1.92 | 1.92 | 2.34 | 2.2 |
| A-7 | 6.42 | 7.25 | 8.48 | 8.0 |
| A-8 | 9.31 | 9.96 | 11.20 | 11.1 |
| A-9 | 7.19 | 6.96 | 6.99 | 7.6 |
| A-10 | 4.41 | 3.72 | 3.01 | 3.6 |
| A-11+ | 0.33 | 0.22 | 0.15 | 0.28 |
| Run Temp., °F. | 721 | 659 | 684 | 733 |

It is clear from the above table that the process of the invention results in a higher octane affording aromatics yield for the naphtha fraction.

Without wishing to be bound by theory it is surmised that the hydrotreating stage of the process of the invention partially hydrogenates the polyaromatics. Subsequently, in the hydrocracking stage the hydrogenated portion of the polyaromatic is preferentially cracked versus the further hydrogenation of the remaining aromatic rings, thus, preserving more aromatics in the product naphtha fraction over the comparative single stage hydrocracking process.

What is claimed is:

1. A multiple stage process for hydroconversion of a hydrocarbon feedstock containing nitrogen- and sulfur-containing compounds which comprises:

(a) contacting said feedstock in a hydrotreating stage comprising a hydrotreating reaction zone wherein hydrogen is contacted with said hydrocarbon feedstock in the presence of a hydrotreating catalyst at hydro-treating conditions wherein a substantial portion of the nitrogen- and sulfur-containing compounds are converted to hydrogen sulfide and ammonia;

(b) passing at least a portion of the effluent from said hydrotreating reaction zone to a stripping zone wherein a substantial portion of the hydrogen sulfide and ammonia is removed from the hydrotreating reaction zone effluent to form a stripping zone effluent;

(c) contacting at least a portion of said stripping zone effluent in a hydrocracking stage, comprising a plurality of hydrocracking reaction zones in series, with hydrogen at hydrocracking conversion conditions which comprises:

(i) contacting said stripping zone effluent in a first hydrocracking reaction zone with a first hydrocracking reaction zone catalyst comprising a nickel component and a molybdenum component deposed on a support component consisting essentially of a refractory inorganic oxide;

(ii) contacting the effluent from said first hydrocracking reaction zone in a second hydrocracking reaction zone with a second hydrocracking reaction zone catalyst comprising a nickel component and a tungsten component deposed on a support component consisting essentially of an alumina component and a crystalline molecular sieve component; and (iii) contacting the effluent from said second hydrocracking reaction zone in a third hydrocracking reaction zone with a third hydrocracking reaction zone catalyst comprising a cobalt component and a molybdenum component deposed on a support component comprising a silica-alumina component and a crystalline molecular sieve component.

2. The process of claim 1 wherein said crystalline molecular sieve component is a Y zeolite.

3. The process of claim 1 wherein said refractory inorganic oxide is alumina.

4. The process of claim 1 wherein a portion of said plurality of reaction zones in series which comprises said first, second, and third hydrocracking reaction zones contains catalyst possessing a small nominal U.S. Sieve mesh size ranging from about 10 to about 16 and the remaining portion of the total amount of catalyst in said plurality of reaction zones, located upstream of the catalyst of small nominal particle size possesses a large nominal particle size, greater than said small nominal size.

5. The process of claim 1 wherein said small nominal particle size ranges from about 10 to about 12 mesh (U.S. Sieve) and said large nominal particle size ranges from about 5 to about 7 mesh (U.S. Sieve).

6. The process of claim 4 wherein said third reaction zone consists of three beds wherein the most downstream bed contains said small nominal size catalyst.

* * * * *

UNITED STATES PATENT OFFICE

CERTIFICATE OF CORRECTION

Patent No. 4,954,241 Dated September 4, 1990

Inventor(s) Simon G. Kukes, Albert L. Hensley, Jr., Jeffrey C. Kelterborn, James L. Aderhold, Jr.

It is certified that error appears in the above-identified patent and that said Letters Patent is hereby corrected as shown below:

| Col. | Line | |
|---|---|---|
| 1 | 39 | "Elements their" should be --Elements, their-- |
| 8 | 23 | "3,6251 $cm^{-1}$" should be --3,625 $cm^{-1}$-- |
| 16 | 61 | "claim 1" should be --Claim 4-- |
| 16 | 65 | "claim 4" should be --Claim 5-- |

Signed and Sealed this

Eleventh Day of February, 1992

*Attest:*

HARRY F. MANBECK, JR.

*Attesting Officer*

*Commissioner of Patents and Trademarks*